United States Patent [19]

Schaechter

[11] 4,144,603

[45] Mar. 20, 1979

[54] METHOD OF RETAINING A PILLOW IN A PILLOW CASE

[76] Inventor: Alan L. Schaechter, 155 Gibson Blvd., Valley Stream, N.Y. 11581

[21] Appl. No.: 810,951

[22] Filed: Jun. 29, 1977

[51] Int. Cl.[2] ..... A47G 9/00

[52] U.S. Cl. ..... 5/339; 5/335

[58] Field of Search ..... 5/334, 337, 335, 338

[56] References Cited

U.S. PATENT DOCUMENTS

| | | | |
|---|---|---|---|
| 823,930 | 6/1906 | Coakley | 5/339 |
| 834,643 | 10/1906 | Schnadig | 5/339 |
| 1,754,937 | 4/1930 | Comstock | 5/339 |

*Primary Examiner*—Mervin Stein
*Assistant Examiner*—Alex Grosz
*Attorney, Agent, or Firm*—Posnack, Roberts, Cohen & Spiecens

[57] ABSTRACT

A method of retaining a pillow in a pillow case which comprises forming a rectangular pillow case which is closed on three sides and has an opening extending along the fourth side and partially closing the fourth side at the edges of the opening to form retainer portions thereat which will contain the pillow in the pillow case. The retainer portions are formed along between about 21 and 37% of the length of the fourth side equally at the side edges to permit insertion of the pillow into the pillow case through the available opening when the pillow is inclined relative to the opening. The retainer portions retain the pillow in the pillow case and prevent removal therefrom unless the pillow is intentionally dislodged in the pillow case and oriented for removal through the opening.

6 Claims, 4 Drawing Figures

FIG. 1
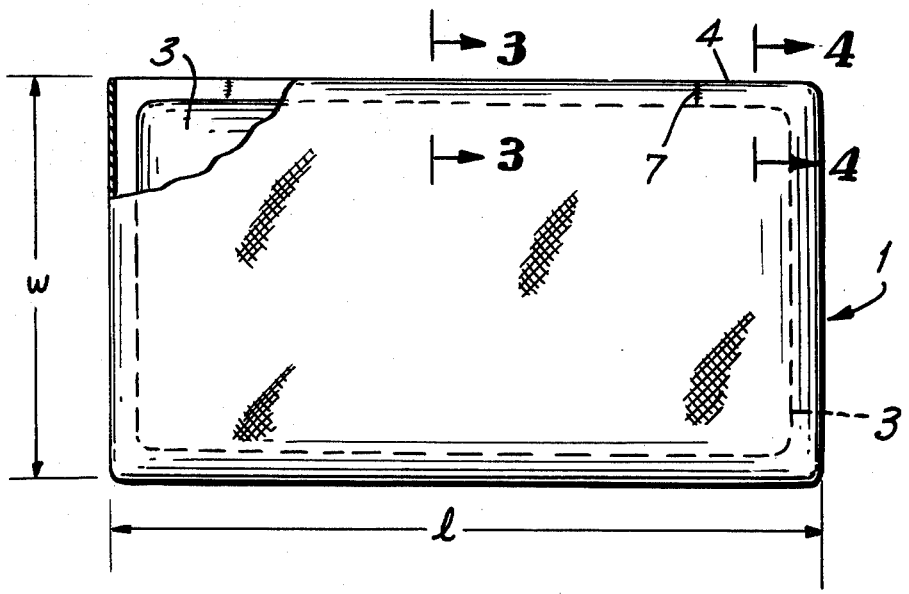
FIG. 2
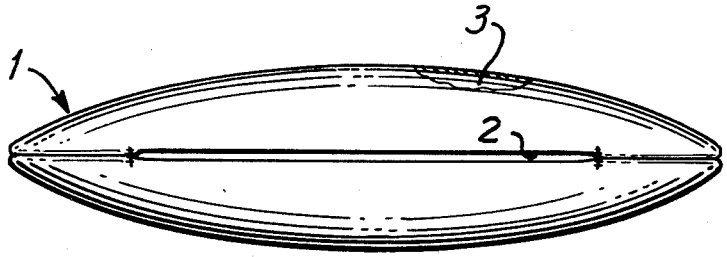
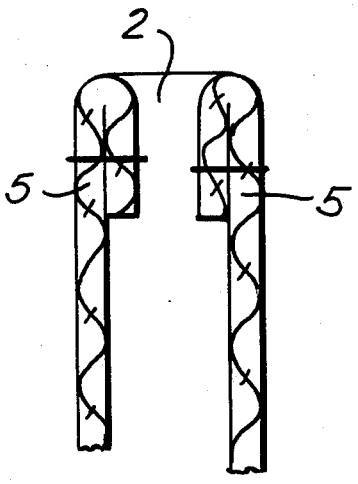
FIG. 3
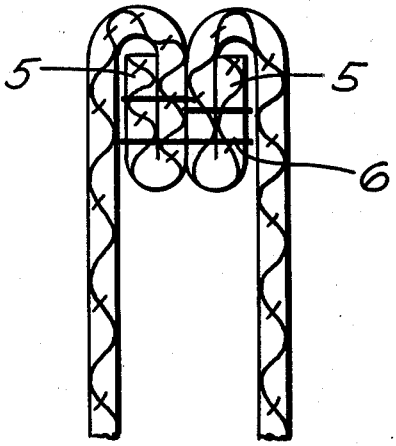
FIG. 4

METHOD OF RETAINING A PILLOW IN A PILLOW CASE

FIELD OF THE INVENTION

The invention is directed to a method of retaining a pillow in a pillow case. More particularly, the invention is concerned with formation of retainer portions at the opening on the long side of a rectangular pillow case in order to permit insertion of a pillow into the pillow case while retaining the pillow therein after its insertion.

PRIOR ART

A conventional pillow case is formed with three sides closed and the fourth side entirely opened through which the pillow is inserted. The opening is formed on the short side of the pillow case and usually conforms to the depth of the pillow. The insertion and removal of the pillow is relatively simple and can be easily carried out. However, in the course of use the pillow frequently tends to slip out from the pillow case and it frequently becomes necessary to re-insert the pillow into the pillow case. On occasion the pillow can come completely out of the case especially when the material of the pillow and/or the pillow case is very fine and smooth.

Various types of fasteners are known for use in forming a closure along the open side of the pillow case to retain the pillow therein. However, such fasteners are costly and sometimes lead to damage of the pillow.

An embodiment of such a fastener is shown in U.S. Pat. No. 834,643 to Schnadig and herein is seen an openable closure along an open edge of the pillow case.

Another configuration is shown in U.S. Pat. No. 1,754,937 in which a covering is provided which employs laces as a closure for an opening of the case. The pillow and case are of football shape and it is necessary to open and close the laces in order to remove the pillow from the case.

Cushion covers are also known which employ flaps and drawstrings such as in U.S. Pat. Nos. 823,930 to Coakley and 2,446,396 to Waranch. Such cases have the disadvantage of requiring a positive action by the user in order to effect the closure of the case for retention of the pillow therein. Furthermore, when the pillow is to be removed the closure must be opened.

SUMMARY OF THE INVENTION

An object of the invention is to provide a pillow case which is easily used and which requires no additional closure members and yet which will positively retain a pillow once inserted therein.

In accordance with the invention there is provided a method of retaining a pillow in a pillow case which comprises forming a rectangular pillow case which is closed on three sides and has an opening extending along the fourth side, partially closing said fourth side at the edges of the opening to form retainer portions thereat which will contain the pillow in the pillow case, the retainer portions being formed along a prescribed distance in relation to the length of said fourth side to permit insertion of the pillow into the pillow case through said opening when the pillow is inclined thereto while retaining the pillow in the pillow case when the pillow is thereafter symmetrically oriented in the pillow case.

In further accordance with the invention the fourth side of the pillow case is permanently closed at said retainer portions.

It is a characteristic feature of the invention that the fourth side of the pillow case is the longer side of the rectangle and the retainer portions constitute between 21 and 37% of the length of the fourth side.

A further feature of the invention is that a reinforcement is formed at the edges of the opening where it joins the retainer portions.

It is further contemplated according to the invention that the retainer portions are formed by permanently securing together two seamed edges of respective layers of the pillow case.

BRIEF DESCRIPTION OF THE DRAWINGS

FIG. 1 of the drawing is a side elevational view of a pillow case according to the invention containing a pillow therein.

FIG. 2 is a top plan view of the pillow case in FIG. 1.

FIG. 3 is a sectional view taken along lines 3—3 in FIG. 1.

FIG. 4 is a sectional view taken along lines 4—4 in FIG. 1.

DETAILED DESCRIPTION

Referring to the drawing there is seen in FIG. 1 a pillow case 1 of rectangular form having a length l and a width w. The upper edge of the pillow case 1 in FIG. 1 has an opening 2 formed therein through which a pillow 3 can be inserted and removed.

The pillow case is similar to a conventional pillow case with the exception that the opening is formed along the long side of the rectangular shape thereof.

In accordance with the invention retainer portions 4 are formed along both edges of the opening 2 and these retainer portions are permanently closed and are of a particular length to contain the pillow in the pillow case. Notwithstanding the presence of the retainer portions it will be possible to insert the pillow into the pillow case through the opening 2 when the pillow is inclined thereto. Once the pillow is contained in the pillow case and is thereafter symmetrically oriented therein the retainer portions will act to contain the pillow in the pillow case and prevent any unintentional removal therefrom.

As can be seen in FIG. 3 the opening 2 is formed between two seamed edge portions 5 of the sides of the pillow case. The retainer portions are formed as best seen in FIG. 4 by permanently securing the two seamed edges 5 together by folding the same over and securing them together with rows of stitches 6; in this way the stitches 6 will be invisible from the outside. A vertical line of reinforcement stitches 7 is formed at each of the edges of the opening 2 at the juncture with the retainer portions 4.

It has been found that in order to permit easy insertion of the pillow into the pillow case while yet affording retention of the inserted pillow it is necessary for the opening 2 to represent between 21 and 37% of the length of the long side of the pillow case. The retainer portions are made equal in length and therefore each one represents between 10.5 and 18.5% of the length of the long side of the pillow case.

It is found that if the retainer portions are made smaller than that indicated hereabove the pillow can slip out of the casing under the ordinary forces applied to it by the head of a user. If the retainer portions are made longer than that indicated hereabove it becomes difficult to insert the pillow into the opening.

In shake tests conducted with the pillow case inverted and the pillow retained therein it was found that the above dimensions of the retainer portions are critical for retaining the pillow within the pillow case.

In general, the pillow case is adapted for use with a pillow whose length and width dimensions represent about 94% of the length and width of the pillow case.

The width to length ratio of the pillow and pillow case varies between 60 and 70%. However, this is not especially critical to the invention.

In further accordance with the geometrical considerations of the size of the pillow case and opening with respect to the pillow it has been found that the opening is best adapted for insertion of the pillow where it has a length representing between 105 and 135% of the width of the pillow.

The above parameters take into account various materials for construction of the pillow case such as cotton, polyesters and the like as well as bulk size of the pillows and its constitution from man made materials such as Dacron and natural materials such as feathers and down.

In a particular embodiment of the invention which is non-limiting in character the following dimensions are obtained:

Length of longer side of the pillow case = $25\frac{3}{4}''$
Length of retainer portion 4 is between $2\frac{3}{4}$ and $4\frac{3}{4}''$
Length of opening 2 is between $16\frac{1}{4}$ and $20\frac{1}{4}''$
Width of case = $17\frac{7}{8}''$
Length of pillow = $24\frac{1}{4}''$
Width of pillow = $15\frac{3}{8}''$ It has been determined according to the invention that by forming the permanent retainer portions at the edges of the opening with the geometrical parameters as given the pillow can be reliably retained in the pillow case and will not be expelled therefrom under normal conditions of usage. For removal of the pillow from the pillow case it is a simple matter to grasp the pillow through the opening and to remove the pillow through the opening with a turning movement. Re-insertion of the pillow is achieved in the reversed manner.

Although the invention has been described in conjunction with a specific embodiment thereof it will become apparent to those skilled in the art that numerous modifications and variations can be made within the scope and spirit of the invention as defined in the attached claims.

What is claimed is:

1. A method of retaining a pillow in a pillow case comprising forming a rectangular pillow case which is closed on three sides and has an opening extending along the fourth side, partially closing said fourth side at the edges of the opening to form retainer portions thereat which will contain the pillow in the pillow case, the retainer portions being formed along a prescribed distance in relation to the length of said fourth side to permit insertion of the pillow into the pillow case through said opening when the pillow is inclined thereto while retaining the pillow case when the pillow is thereafter symmetrically oriented in the pillow case, said fourth side being the longer side of the rectangle, said retainer portions constituting between 21 and 37% of the length of said fourth side, said pillow having a length representing about 94% of the length of the fourth side.

2. A method as claimed in claim 1 wherein said fourth side is permanently closed at said retainer portions.

3. A method as claimed in claim 1 comprising forming a reinforcement at the edges of said opening where it joins said retainer portions.

4. A method as claimed in claim 1 wherein said opening has a length representing between 105 and 135% of the width of the pillow.

5. A method as claimed in claim 4 wherein said pillow has a width of between about 60 and 70% of the width of the pillow case.

6. A method as claimed in claim 1 wherein said retainer portions are formed by permanently securing together two seamed edges of respective layers of the pillow case.

* * * * *